US011514840B2

(12) United States Patent
Jang

(10) Patent No.: US 11,514,840 B2
(45) Date of Patent: Nov. 29, 2022

(54) LIGHT EMISSION CONTROL DRIVER AND DISPLAY DEVICE INCLUDING THE SAME

(71) Applicant: Samsung Display Co., Ltd., Yongin-si (KR)

(72) Inventor: Hwan Soo Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 43 days.

(21) Appl. No.: 17/005,323

(22) Filed: Aug. 28, 2020

(65) Prior Publication Data

US 2021/0134213 A1 May 6, 2021

(30) Foreign Application Priority Data

Nov. 5, 2019 (KR) ..... 10-2019-0140507

(51) Int. Cl.
*G09G 3/32* (2016.01)

(52) U.S. Cl.
CPC ..... *G09G 3/32* (2013.01); *G09G 2300/0426* (2013.01); *G09G 2300/08* (2013.01); *G09G 2310/0267* (2013.01); *G09G 2310/0275* (2013.01); *G09G 2310/0286* (2013.01); *G09G 2310/08* (2013.01)

(58) Field of Classification Search
CPC ..... G09G 3/3233; G09G 3/3258; G09G 2310/0286; G09G 3/3266; G09G 2300/0426; G09G 2300/08; G09G 2300/0819; G09G 2300/0842; G09G 2300/0861; G09G 2310/0251; G09G 2310/0267; G09G 2310/0275; G09G 2310/08; G09G 3/30–3291; G09G 2320/0633; G09G 3/32–3291; G11C 19/28–287
USPC ..... 345/76–83, 100; 377/64–81
See application file for complete search history.

(56) References Cited

U.S. PATENT DOCUMENTS 9,318,055 B2 4/2016 Kim et al.
9,548,026 B2 1/2017 Jang
10,453,386 B2 10/2019 Jang
(Continued)

FOREIGN PATENT DOCUMENTS

KR 10-2014-0025149 3/2014
KR 10-2014-0147998 12/2014
(Continued)

*Primary Examiner* — Amr A Awad
*Assistant Examiner* — Aaron Midkiff
(74) *Attorney, Agent, or Firm* — H.C. Park & Associates, PLC

(57) ABSTRACT

A light emission control driver includes stages, each including: an input circuit controlling voltages of first and second nodes (N1, N2) based on a first clock signal (CS) and one of a start signal and a carry signal; a first main circuit controlling a voltage of a third node (N3) based on the voltage of N1 and a second CS; a second main circuit controlling the voltage of N3 based on the voltage of N2; an output circuit controlling output of an emission control signal (ECS) based on the voltages of N2 and N3; a first auxiliary circuit controlling a low level output of the ECS from a first low level to a second low level based on the second CS; and a second auxiliary circuit controlling the low level output in a single step from a high level to the second low level based on the voltage of N2.

18 Claims, 9 Drawing Sheets

(56) References Cited

U.S. PATENT DOCUMENTS

| | | | | |
|---|---|---|---|---|
| 2017/0287395 | A1* | 10/2017 | Jang | G09G 3/3266 |
| 2017/0345366 | A1* | 11/2017 | Jang | G09G 3/3225 |
| 2017/0365211 | A1* | 12/2017 | Lee | G09G 3/3275 |
| 2020/0168160 | A1 | 5/2020 | Oh et al. | |
| 2020/0302870 | A1 | 9/2020 | Jang | |
| 2020/0394952 | A1 | 12/2020 | Na et al. | |
| 2021/0074215 | A1 | 3/2021 | Park et al. | |
| 2021/0193040 | A1 | 6/2021 | Na | |

FOREIGN PATENT DOCUMENTS

| | | |
|---|---|---|
| KR | 10-2017-0133578 | 12/2017 |
| KR | 10-2020-0061469 | 6/2020 |
| KR | 10-2020-0111322 | 9/2020 |
| KR | 10-2020-0142161 | 12/2020 |
| KR | 10-2021-0029336 | 3/2021 |
| KR | 10-2021-0081507 | 7/2021 |

* cited by examiner

LIGHT EMISSION CONTROL DRIVER AND DISPLAY DEVICE INCLUDING THE SAME

CROSS-REFERENCE TO RELATED APPLICATION

This application claims priority to and the benefit of Korean Patent Application No. 10-2019-0140507, filed Nov. 5, 2019, which is hereby incorporated by reference for all purposes as if fully set forth herein.

BACKGROUND

Field

Some exemplary embodiments generally relate to a light emission control driver and a display device including the same.

Discussion

With the development of information technologies, the importance of a display device as a connection medium between a user and information increases. Accordingly, display devices, such as liquid crystal display devices, organic light emitting display devices, plasma display devices, etc., are being increasingly used.

Each pixel of a display device may emit light with a luminance corresponding to a data voltage supplied through a data line. The display device may display an image frame by using a combination of light emitted from the pixels. In addition, an emission period of each pixel of the display device may be controlled according to an emission control signal supplied through an emission control line. Accordingly, a light emission control driver capable of supplying the emission control signal to each pixel may be used.

The above information disclosed in this section is only for understanding the background of the inventive concepts, and, therefore, may contain information that does not form prior art.

SUMMARY

Some aspects provide a light emission control driver capable of improving an output characteristic when an emission control signal has a low level.

Some aspects provide display device including a light emission control driver capable of improving an output characteristic when an emission control signal has a low level.

Additional aspects will be set forth in the detailed description which follows, and, in part, will be apparent from the disclosure, or may be learned by practice of the inventive concepts.

According to some aspects, a light emission control drivers includes stages configured to supply an emission control signal to emission control lines. Each of the stages includes an input circuit, a first main circuit, a second main circuit, an output circuit, a first auxiliary circuit, and a second auxiliary circuit. The input circuit is configured to control a voltage of a first node and a voltage of a second node based on a first clock signal and one of an emission start signal and a carry signal of a previous stage among the stages. The first main circuit is configured to control a voltage of a third node based on the voltage of the first node and a second clock signal. The second main circuit is configured to control the voltage of the third node based on the voltage of the second node such that the third node has a voltage level opposite a voltage level of the second node. The output circuit is configured to control the emission control signal output to an output terminal based on the voltage of the second node and the voltage of the third node. The first auxiliary circuit is configured to control a low level output of the emission control signal such that the emission control signal is further lowered from a first low level to a second low level based on the second clock signal. The second auxiliary circuit is configured to control the low level output of the emission control signal in a single step from a high level to the second low level based on the voltage of the second node.

According to some aspects, a display device includes pixels, a scan driver configured to supply a scan signal to the pixels, a data driver configured to supply a data signal to the pixels, a light emission control driver including stages configured to supply an emission control signal to the pixels, and a timing controller configured to control driving of the scan driver, the data driver, and the light emission control driver. Each of the stages includes an input circuit, a first main circuit, a second main circuit, an output circuit, a first auxiliary circuit, and a second auxiliary circuit. The input circuit is configured to control a voltage of a first node and a voltage of a second node based on a first clock signal and one of an emission start signal and a carry signal of a previous stage among the stages. The first main circuit is configured to control a voltage of a third node based on the voltage of the first node and a second clock signal. The second main circuit is configured to control the voltage of the third node based on the voltage of the second node such that the third node has a voltage level opposite a voltage level of the second node. The output circuit is configured to control the emission control signal output to an output terminal based on the voltage of the second node and the voltage of the third node. The first auxiliary circuit is configured to control a low level output of the emission control signal such that the emission control signal is further lowered from a first low level to a second low level based on the second clock signal. The second auxiliary circuit is configured to control the low level output of the emission control signal in a single step from a high level to the second low level based on the voltage of the second node.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF SOME EXEMPLARY EMBODIMENTS

Figure 1:
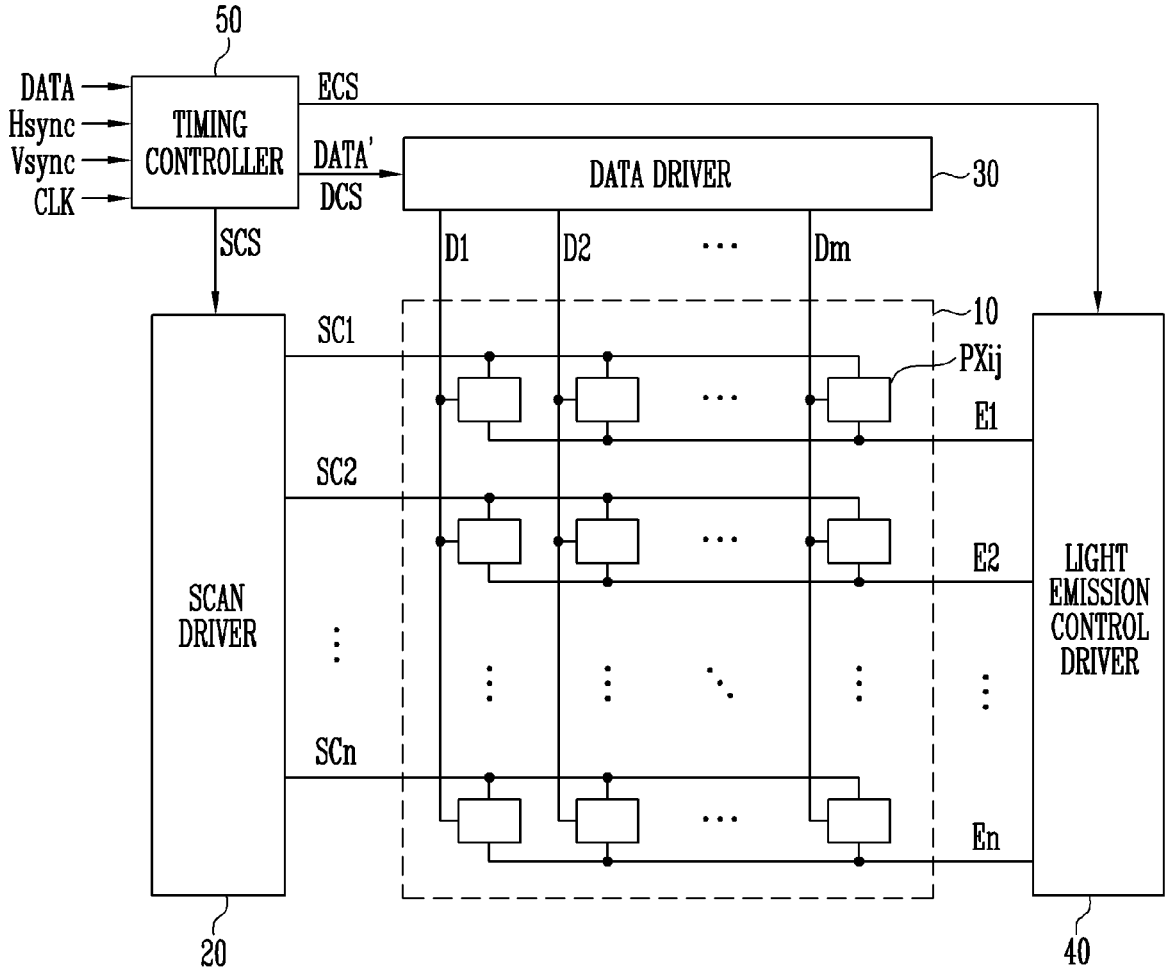
FIG. 1 is a block diagram of a display device according to some exemplary embodiments.

In the following description, for the purposes of explanation, numerous specific details are set forth in order to provide a thorough understanding of various exemplary embodiments. As used herein, the terms "embodiments" and "implementations" are used interchangeably and are non-limiting examples employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various exemplary embodiments will be explained in detail with reference to the accompanying drawings.

FIG. 1 is a block diagram of a display device according to some exemplary embodiments.

Referring to FIG. 1, a display device according to some exemplary embodiments may include a pixel unit (or structure) 10, a scan driver 20, a data driver 30, a light emission control driver 40, and a timing controller 50.

The pixel unit 10 includes a plurality of pixels PXij coupled to a plurality of scan line SC1 to SCn (n being an integer greater than or equal to 2), a plurality of data lines D1 to Dm (m being an integer greater than or equal to 2), and a plurality of emission control lines E1 to En arranged in a formation, such as a matrix formation. The pixels PXij receive a scan signal through the scan lines SC1 to SCn, receive a data signal through the data lines D1 to Dm, and receive an emission control signal through the emission control lines E1 to En. The pixels PXij emit light with a luminance corresponding to a data signal supplied from the data lines D1 to Dm in response to a scan signal being supplied from the scan lines SC1 to SCn.

The scan driver 20 is coupled to the plurality of scan lines SC1 to SCn, generates a scan signal in response to a scan driving control signal SCS supplied from the timing controller 50, and outputs the generated scan signal to the scan lines SC1 to SCn. The scan driver 20 may be configured with a plurality of stage circuits. The scan driver 20 may sequentially provide a scan signal having a pulse of a turn-on level to the pixels PXij through the scan lines SC1 to SCn. The scan driver 20 may be configured in a shift register form.

The data driver 30 is coupled to the plurality of data lines D1 to Dm, generates a data signal based on a data driving control signal DCS and image data DATA' that are supplied from the timing controller 50, and outputs the generated data signal to the data lines D1 to Dm. The data signal supplied to the data lines D1 to Dm is supplied to pixels PXij selected by a scan signal whenever the scan signal is supplied. The pixels PXij may charge a voltage corresponding to the data signal.

The light emission control driver 40 is coupled to the plurality of emission control lines E1 to En, generates an emission control signal in response to an emission driving control signal ECS, and outputs the generated emission control signal to the emission control lines E1 to En. The light emission control driver 40 may be configured with a plurality of stage circuits, and may control an emission period of the pixels PXij by supplying the emission control signal to the emission control lines E1 to En.

The timing controller 50 may receive various signals, such as image data DATA, synchronization signals Hsync and Vsync, a clock signal CLK, and/or the like, which are used to control display of the image data DATA. The timing controller 50 generates image data DATA' corrected to be suitable for image display via the pixel unit 10 by image-processing the received image data DATA, and outputs the generated image data DATA' to the data driver 30. Also, the timing controller 50 may generate driving control signals SCS, DCS, and ECS for controlling driving of the scan driver 20, the data driver 30, and the light emission control driver 40 based on the synchronization signals Hsync and Vsync and the clock signal CLK. For example, the timing controller 50 may generate a scan driving control signal SCS and supply the generated scan driving control signal SCS to the scan driver 20, generate a data driving control signal DCS and supply the generated data driving control signal DCS to the data driver 30, and generate an emission driving control signal ECS and supply the generated emission driving control signal ECS to the light emission control driver 40.

Figure 2:
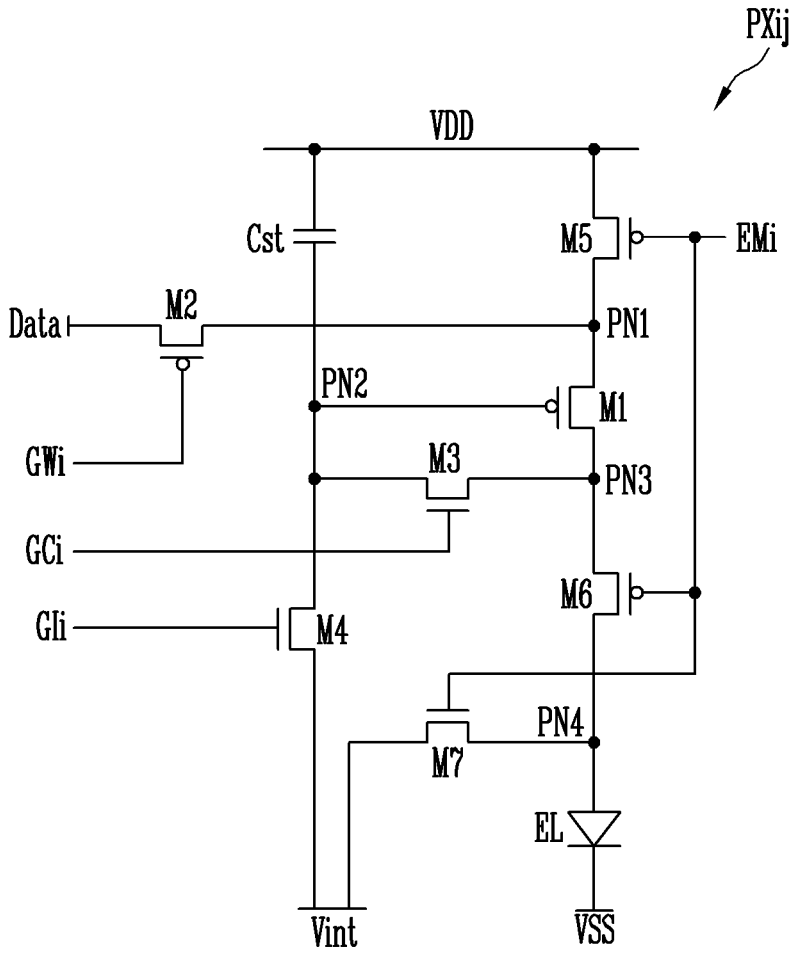
FIG. 2 is a circuit diagram of a pixel of the display device shown in FIG. 1 according to some exemplary embodiments.

FIG. 2 is a circuit diagram of a pixel of the display device shown in FIG. 1 according to some exemplary embodiments.

For convenience of description, a pixel PXij located on an i-th line (e.g., an i-th horizontal line) and coupled to a j-th data line is illustrated and will be described in association with FIG. 2.

Referring to FIG. 2, the pixel PXij may include a first transistor M1, a second transistor M2, a third transistor M3, a fourth transistor M4, a fifth transistor M5, a sixth transistor M6, a seventh transistor M7, a storage capacitor Cst, and a light emitting device EL.

In an embodiment, a first scan signal GWi may be a scan signal supplied to a first scan line coupled to the i-th horizontal line, a second scan signal GCi may be a scan signal supplied to a second scan line coupled to the i-th horizontal line, and a third scan signal GIi may be a scan signal supplied to a third scan line coupled to the i-th horizontal line.

The second transistor M2 may be coupled between a data line to which a data voltage (or signal) Data is supplied and a first pixel node PN1, and may be turned on by the first scan signal GWi through the first scan line. the second transistor M2 may be referred to as a switching transistor.

The first transistor M1 may be coupled between the first pixel node PN1 and a third pixel node PN3. The first transistor M1 may be referred to as a driving transistor. A gate electrode of the first transistor M1 may be coupled to a second pixel node PN2.

The third transistor M3 may be coupled between the second pixel node PN2 and the third pixel node PN3, and may be turned on by the second scan signal GCi through the second scan line. The third transistor M3 may be referred to as a compensation transistor.

The storage capacitor Cst may be coupled between a line to which a voltage of a first driving power source VDD is supplied and the second pixel node PN2. Therefore, the second transistor M2 may be turned on by the first scan signal GWi, and the data voltage Data through the data line may be charged in (or by) the storage capacitor Cst when the third transistor M3 is turned on by the second scan signal GCi.

The fourth transistor M4 may be coupled between the second pixel node PN2 and a line to which an initialization voltage Vint is supplied, and may be turned on by the third scan signal GIi through the third scan line. The fourth transistor M4 may be referred to as a first initialization transistor. When the fourth transistor M4 is turned on by the third scan signal GIi, the voltage charged in the storage capacitor Cst may be initialized to the initialization voltage Vint. For instance, when the fourth transistor M4 is turned on by the third scan signal GIi, the storage capacitor Cst may output a discharge voltage according to the initialization voltage Vint. Generally speaking, the initialization voltage Vint may be defined as a voltage for initializing the pixel PXij.

The fifth transistor M5 may be coupled between the first driving power source VDD and the first pixel node PN1, and may be turned on by an emission control signal EMi having a low level. The fifth transistor M5 may be referred to as an operation control transistor. Hereinafter, the emission control signal EMi may mean (or refer to) an emission control signal supplied to each pixel PXij through an arbitrary i-th emission control line among the emission control lines E1, E2, . . . , En shown in FIG. 1.

The sixth transistor M6 may be coupled between the third pixel node PN3 and a fourth pixel node PN4, and may be turned on by the emission control signal EMi having the low level. The sixth transistor M6 may be referred to as an emission control transistor.

An anode of the light emitting device EL may be coupled to the fourth pixel node PN4, and a cathode of the light emitting device EL may be coupled to a line to which a voltage of a second driving power source VSS is supplied so that the light emitting device EL can emit light with a luminance corresponding to a driving current.

Therefore, when the fifth transistor M5 and the sixth transistor M6 are turned on by the emission control signal EMi, a driving current corresponding to the voltage charged in the storage capacitor Cst may be provided to the light emitting device EL.

The seventh transistor M7 may be coupled between the line to which the initialization voltage Vint is supplied and the fourth pixel node PN4, and may be turned off by the emission control signal EMi having the low level. The seventh transistor M7 may be referred to as a second initialization transistor. When the seventh transistor M7 is turned on, a parasitic capacitor (not shown) existing in the light emitting device EL may be initialized by the initialization voltage Vint. For example, when a voltage difference (Vint-VSS) between the initialization voltage Vint and the voltage of the second driving power source VSS is applied to the parasitic capacitor of the light emitting device EL, the light emitting device EL may be discharged according to the voltage difference (Vint-VSS) applied to the parasitic capacitor.

In FIG. 2, the first, second, fifth, and sixth transistors M1, M2, M5, and M6 are illustrated as P-type transistors, and the third, fourth, and seventh transistors M3, M4, and M7 are illustrated as N-type transistors. Therefore, when a voltage applied to a gate electrode of the P-type transistor has a low level, the low level may be referred to as a turn-on level. When the voltage applied to the gate electrode of the P-type transistor has a high level, the high level may be referred to as a turn-off level. Similarly, when a voltage applied to a gate electrode of the N-type transistor has a high level, the high level may be referred to as a turn-on level. When the voltage applied to the gate electrode of the N-type transistor has a low level, the low level may be referred to as a turn-off level. It is contemplated, however, that at least some of the transistors M1, M2, M3, M4, M5, M6, and M7 may be changed to N-type transistors (or P-type transistors).

Figure 3:
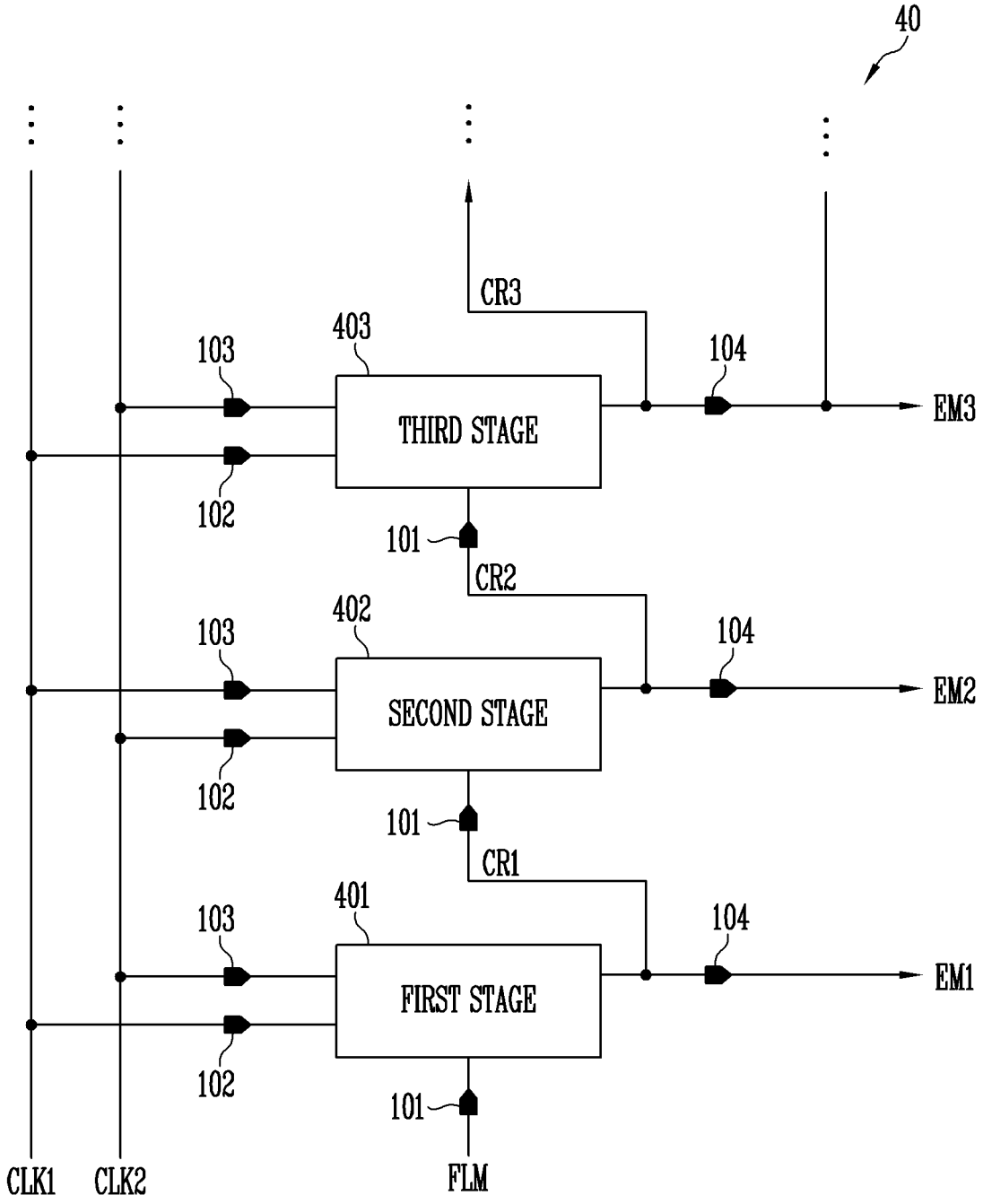
FIG. 3 is a diagram of a light emission control driver according to some exemplary embodiments.

FIG. 3 is a diagram illustrating a light emission control driver according to some exemplary embodiments.

Referring to FIGS. 1 and 3 together, the light emission control driver 40 may include a plurality of stages, such as stages 401, 402, and 403, for supplying emission control signals, such as emission control signals EM1, EM2, and EM3, to the emission control lines E1 to En. For convenience of description, only three stages 401, 402, and 403 and three emission control signals EM1, EM2, and EM3 are illustrated in FIG. 3, but exemplary embodiments are not limited thereto. Hereinafter, the stages of light emission control driver 40 may be referred to as stages 401, 402, and 403 without limitation on the number of stages of light emission control driver 40. Similarly, the emission control signals output by light emission control driver 40 may be referred to as emission control signals EM1, EM2, and EM3 without limitation on the number of emission control signals output by light emission control driver 40.

The stages 401, 402, and 403 are driven by an emission start signal FLM, a first clock signal CLK1, and a second clock signal CLK2, and output emission control signals EM1, EM2, and EM3. The emission start signal FLM, the first clock signal CLK1, and the second clock signal CLK2 may be received through the emission driving control signal ECS from the timing controller 50. The stages 401, 402, and 403 may be configured with circuits identical to or different from one another.

Each of the stages 401, 402, and 403 may include a first input terminal 101, a second input terminal 102, a third input terminal 103, and an output terminal 104.

The first input terminal 101 may receive a carry signal, such as one of carry signals CR1, CR2, and CR3, or the emission start signal FLM. For example, a first stage 401 may receive the emission start signal FLM through the first input terminal 101, and each of the other stages may receive a carry signal, such as one of carry signals CR1, CR2, and CR3, of a previous stage through the first input terminal 101. Similar, to the emission control signals EM1, EM2, and EM3, the carry signals output by stages 401, 402, and 403 may be referred to as carry signals CR1, CR2, and CR3 without limitation on the number of carry signals output by stages 401, 402, and 403. It is noted, however, that the carry signals CR1, CR2, and CR3 may include one of emission control signals EM1, EM2, and EM3 of a previous stage.

The second input terminal 102 and the third input terminal 103 may receive the first clock signal CLK1 and the second clock signal CLK2, respectively.

The output terminal 104 may be coupled to one of the emission control lines E1, E2, . . . , and En such that an emission control signal EM1, EM2, and EM3 can be output therethrough.

The first clock signal CLK1 or the second clock signal CLK2 may be a square wave signal having a logic high level and a logic low level that are repeated. The first clock signal CLK1 and the second clock signal CLK2 may have the same period, and the period may be, for example, one horizontal period 1H or two horizontal periods 2H. The first clock signal CLK1 and the second clock signal CLK2 may be signals having the same wavelength. The first clock signal CLK1 and the second clock signal CLK2 may have a phase difference of a half period, and gate-on voltage periods of the first clock signal CLK1 and the second clock signal CLK2 may be set not to overlap with each other. For example, during a period in which the first clock signal CLK1 has the logic high level, the second clock signal CLK2 may have the logic low level. During a period in which the first clock signal CLK1 has the logic low level, the second clock signal CLK2 may have the logic high level. However, this is merely illustrative, and the wavelength relationship between the first clock signal CLK1 and the second clock signal CLK2 is not necessarily limited thereto.

Referring to FIG. 3, the first stage 401 may output a first emission control signal EM1 to pixels coupled to an emission control line (one of emission control lines E1 to En) and output a first carry signal CR1 to a second stage 402 in response to the emission start signal FLM and the first and second clock signals CLK1 and CLK2.

The second stage 402 may output a second emission control signal EM2 to pixels coupled to an emission control line (one of emission control lines E1 to En) and output a second carry signal CR2 to a third stage 403 in response to the first clock signal CLK1, the second clock signal CLK2, and the first carry signal CR1.

The third stage 403 may output a third emission control signal to pixels coupled to an emission control line (one of emission control lines E1 to En) and output a third carry signal CR3 to a fourth stage in response to the first clock signal CLK1, the second clock signal CLK2, and the second carry signal CR2.

Although a case where each stage directly receives the first clock signal CLK1 and the second clock signal CLK2 through the second input terminal 102 and the third input terminal 103 is illustrated in FIG. 3, embodiments are limited thereto. In some embodiments, the first stage 401 may directly receive the first clock signal CLK1 and the second clock signal CLK2, but each of the other stages, e.g., states 402 and 403, may receive any one of the first clock signal CLK1 and the second clock signal CLK2 from a previous stage. In an embodiment, each of the odd-numbered stages, such as stage 403, except for the first stage 401, may receive the first clock signal CLK1 from a previous stage, and directly receive the second clock signal CLK2. Each of the even-numbered stages, such as stage 402, may directly receive the first clock signal CLK1 and receive the second clock signal CLK2 from a previous stage. In accordance with some embodiments, each of the carry signals, such as carry signals CR1, CR2, and CR3, may include at least one of the first clock signal CLK1 and the second clock signal CLK2.

In addition, the first clock signal CLK1 and the second clock signal CLK2 may be alternately input when the first clock signal CLK1 and the second clock signal CLK2 are input to each stage. For example, as shown in FIG. 3, each of the odd-numbered stages (e.g., stages 401 and 403) may receive the first clock signal CLK1 through the second input terminal 102, and receive the second clock signal CLK2 through the third input terminal 103. Each of the even-numbered stages (e.g., stage 402) may receive the second clock signal CLK2 through the second input terminal 102, and receive the first clock signal CLK1 through the third input terminal 103.

Figure 4:
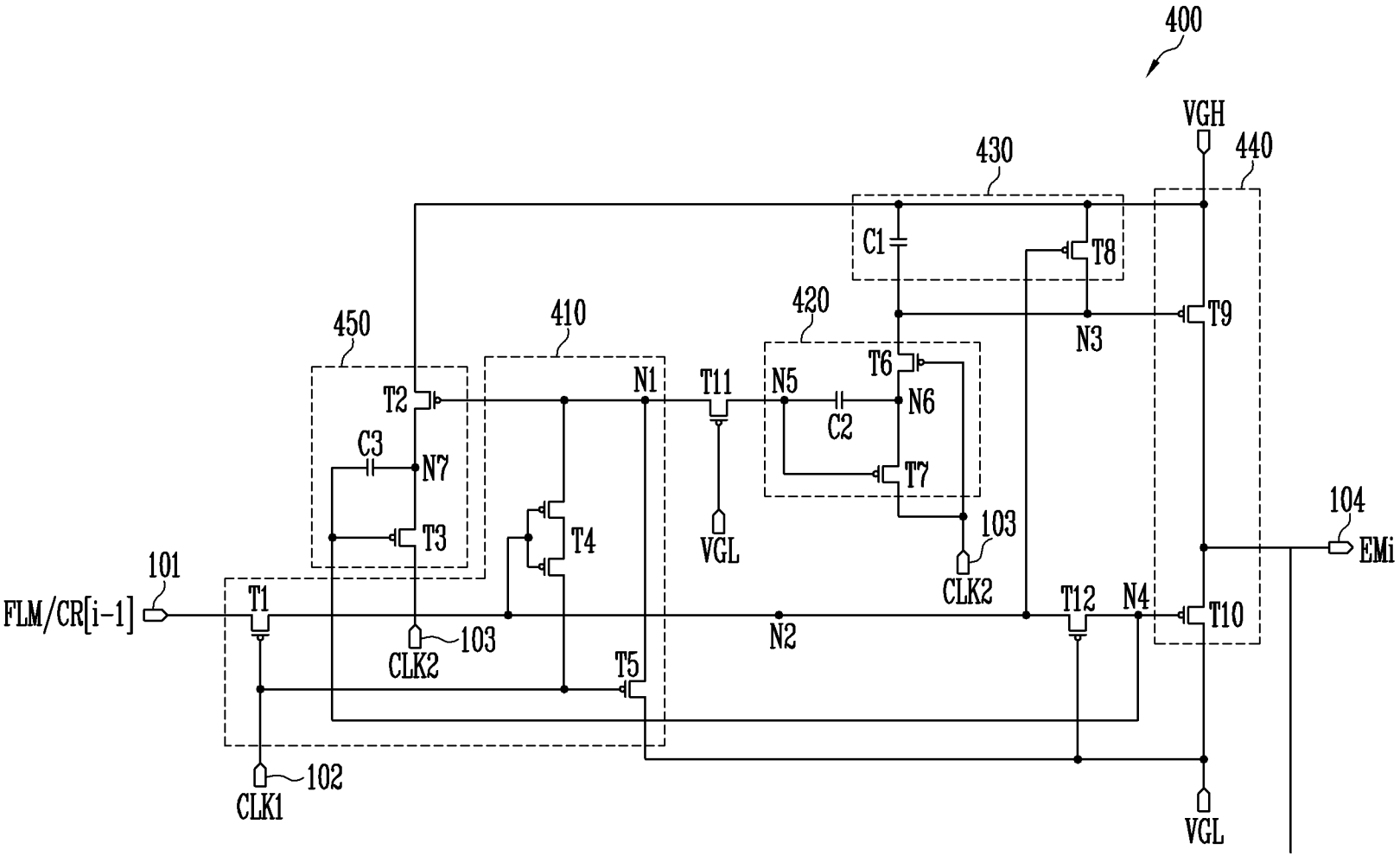
FIG. 4 is a circuit diagram of a first illustrative stage shown in FIG. 3 according to some exemplary embodiments.

FIG. 4 is a circuit diagram a first illustrative stage shown in FIG. 3 according to some exemplary embodiments.

Referring to FIG. 4, the stage 400 in accordance some embodiments may include an input circuit 410, a first main circuit 420, a second main circuit 430, an output circuit 440, and a first auxiliary circuit 450. The stage 400 shown in FIG. 4 may represent a circuit diagram of an arbitrary i-th stage among the plurality of stages 401, 402, and 403 shown in FIG. 3. Hereinafter, although a case where the first clock signal CLK1 and the second clock signal CLK2 are respectively received through the second input terminal 102 and the third input terminal 103 is described, the opposite case may be included as described in association with FIG. 3.

Also, in the stage 400 shown in FIG. 4, a first power source VGH may provide a high level voltage (or gate-off voltage) for turning off P-type transistors, and a second power source VGL may provide a low level voltage (or gate-on voltage) for turning on P-type transistors.

The input circuit 410 may control a voltage of a first node N1 and a voltage of a second node N2 based on one of the emission start signal FLM and a carry signal CR[i−1] of a previous stage and further based on the first clock signal CLK1. For example, when the stage 400 shown in FIG. 4 is the first stage 401 shown in FIG. 3, the emission start signal FLM may be input to the input circuit 410 through the first input terminal 101. When the stage 400 shown in FIG. 4 is one of the other stages besides the first stage 401, the carry signal CR[i−1] of the previous stage may be input to the input circuit 410 through the first input terminal 101.

In some embodiments, the input circuit 410 may include a first transistor T1, a fourth transistor T4, and a fifth transistor T5. The first transistor T1 may be coupled between the first input terminal 101 to which one of the emission start signal FLM and the carry signal CR[i−1] of the previous stage is input and the second node N2. The second input terminal 102 may be coupled to a gate electrode of the first transistor T1. Therefore, the first transistor T1 may be turned on or turned off according to the first clock signal CLK1.

The fourth transistor T4 may be coupled between the first node N1 and the second input terminal 102. A gate electrode of the fourth transistor T4 may be coupled to the second node N2. Therefore, the fourth transistor T4 may be turned on or turned off according to a voltage applied to the second node N2. As shown in FIG. 4, the fourth transistor T4 may include a first sub-transistor and a second sub-transistor that have a commonly coupled gate electrode and are coupled in series to each other. The commonly coupled gate electrode of the first sub-transistor and the second sub-transistor may be coupled to the second node N2. As described above, the fourth transistor T4 may be configured with a plurality of sub-transistors so that a current path can be formed between the first node N1 and the second input terminal 102 even when a voltage difference between the first node N1 and the second node N2 is high.

The fifth transistor T5 may be coupled between the first node N1 and the second power source VGL. A gate electrode of the fifth transistor T5 may be coupled to the second input terminal 102 to which the first clock signal CLK1 is input. Therefore, the fifth transistor T5 may be turned on or turned off according to the first clock signal CLK1.

The first main circuit 420 may control a voltage of a third node N3 based on a voltage applied to a fifth node N5 and the second clock signal CLK2. The first main circuit 420 may include a second capacitor C2, a sixth transistor T6, and a seventh transistor T7. The sixth transistor T6 may be coupled between the third node N3 and a sixth node N6. The seventh transistor T7 may be coupled between the sixth node N6 and the third input terminal 103. A gate electrode of the sixth transistor T6 may be coupled to the third input terminal 103 to which the second clock signal CLK2 is input. Therefore, the sixth transistor T6 may be turned on or turned off according to the second clock signal CLK2. A gate electrode of the seventh transistor T7 may be coupled to the fifth node N5. Therefore, the seventh transistor T7 may be turned on or turned off according to the voltage applied to the fifth node N5. The second capacitor C2 may be coupled between the sixth node N6 and the fifth node N5.

The first node N1 and the fifth node N5 may be the same, but embodiments are not limited thereto. For example, the stage 400 may further include an eleventh transistor T11 coupled between the first node N1 of the input circuit 410 and the fifth node N5 of the first main circuit 420. The eleventh transistor T11 may limit (or otherwise control or adjust) the voltage of the first node N1 to be lower (e.g., extremely lower) than the voltage of the fifth node N5. For instance, the eleventh transistor T11 may limit a voltage drop width of the first node N1.

A gate electrode of the eleventh transistor T11 may be coupled to the second power source VGL. Since the second power source VGL has a low level voltage (or a voltage inducing the P-type transistor to be in a turn-on state), the eleventh transistor T11 may be always maintained in the turn-on state. Therefore, the voltage of the first node N1 and the voltage of the fifth node N5 may be maintained equal (or substantially equal) to each other, and hence, the voltage applied to the first node N1 of the input circuit 410 may be applied to the fifth node N5 of the first main circuit 420.

The second main circuit 430 may output the voltage of the third node N3 such that the third node N3 has a voltage with a level opposite to that of a voltage of the second node N2 (e.g., such that the voltage of the second node N2 has a low level when the voltage of the third node N3 has a high level) based on the voltage applied to the second node N2. The second main circuit 430 may include a first capacitor C1 and an eighth transistor T8. The eighth transistor T8 may be coupled between the first power source VGH and the third node N3. A gate electrode of the eighth transistor T8 may be coupled to the second node N2. Therefore, the eighth transistor T8 may be turned on or turned off according to the voltage applied to the second node N2. The first capacitor C1 may be coupled between the first power source VGH and the third node N3. Therefore, after the first capacitor C1 is charged when a voltage having a low level is applied to the third node N3, the first capacitor C1 may assist a ninth transistor T9 of the output circuit 440 to maintain the turn-on state.

The output circuit 440 may control an emission control signal EMi output through the output terminal 104 based on a voltage applied to the third node N3 and a voltage applied to a fourth node N4. The output circuit 440 may include the ninth transistor T9 and a tenth transistor T10.

The ninth transistor T9 may be coupled between the first power source VGH and the output terminal 104 through which the emission control signal EMi is output. A gate electrode of the ninth transistor T9 may be coupled to the third node N3. Therefore, the ninth transistor T9 may be turned on or turned off according to the voltage applied to the third node N3. When the ninth transistor T9 is turned on, the emission control signal EMi having a high level may be output while a current according to the first power source VGH is flowing to the output terminal 104.

The tenth transistor T10 may be coupled between the output terminal 104 and the second power source VGL. A gate electrode of the tenth transistor T10 may be coupled to the fourth node N4. Therefore, the tenth transistor T10 may be turned on or turned off according to a voltage input to the fourth node N4. When the tenth transistor T10 is turned on, the emission control signal EMi having a low level according to the second power source VGL may be output.

The second node N2 and the fourth node N4 may be the same, but embodiments are not limited thereto. For example, the stage 400 may further include a twelfth transistor T12 coupled between the second node N2 of the input circuit 410 and the fourth node N4 of the output circuit 440. The twelfth transistor T12 may limit (or otherwise control or adjust) the voltage of the second node N2 to be lower (e.g., extremely lower) than the voltage of the fourth node N4. For instance, the twelfth transistor T12 may limit a voltage drop width of the second node N2.

The second power source VGL may be input to a gate electrode of the twelfth transistor T12. Since the second power source VGL has a low level voltage (or a voltage inducing the P-type transistor to be in a turn-on state), the twelfth transistor T12 may always be maintained in the turn-on state. Therefore, the voltage of the second node N2 and the voltage of the fourth node N4 may be maintained equal (or substantially equal) to each other, and hence, the voltage applied to the second node N2 of the input circuit 410 may be applied to the fourth node N4 of the output circuit 440.

In some embodiments, the stage 400 may further include the first auxiliary circuit 450 that assists the fourth node N4 to stably maintain a low level (or assists the tenth transistor T10 of the output circuit 440 to be stably in the turn-on state) based on the voltage applied to the fourth node N4 and the second clock signal CLK2.

The first auxiliary circuit 450 may include a third capacitor C3, a second transistor T2, and a third transistor T3. The second transistor T2 may be coupled between the first power source VGH and a seventh node N7. A gate electrode of the second transistor T2 may be coupled to the first node N1. Therefore, the second transistor T2 may be turned on or turned off according to the voltage applied to the first node N1. The third capacitor C3 may be coupled between the fourth node N4 and the seventh node N7.

The third capacitor C3 may additionally decrease (or otherwise control or adjust) the voltage of the fourth node N4 that is changed to a low level by the magnitude of a voltage charged therein in response to the emission start signal FLM or the carry signal CR[i−1] of a previous stage being changed to a low level.

When the voltage of the fourth node N4 is further decreased, a voltage difference Vgs between the gate electrode and a source electrode of the tenth transistor T10 may be maintained less than or equal to a threshold voltage of the tenth transistor T10, and therefore, the emission control signal EMi may be maintained at a sufficiently low level. Thus, the first auxiliary circuit 450 including the third capacitor C3 can assist the emission control signal EMi to generate a sufficiently low level signal, and reduce power consumption.

The transistor T3 may be coupled between the seventh node N7 and the third input terminal 103. A gate electrode of the third transistor T3 may be coupled to the fourth node N4. Therefore, the third transistor T3 may be turned on or turned off according to the voltage applied to the fourth node N4.

The first to twelfth transistors T1 to T12 may be P-type transistors. Therefore, a gate-on voltage of each of the first to twelfth transistors T1 to T12 may be a low level, and a gate-off voltage of each of the first to twelfth transistors T1 to T12 may be a high level. Embodiments, however, are not limited thereto. For instance, all or some of the first to twelfth transistors T1 to T12 may be replaced with N-type transistors.

Figure 5:
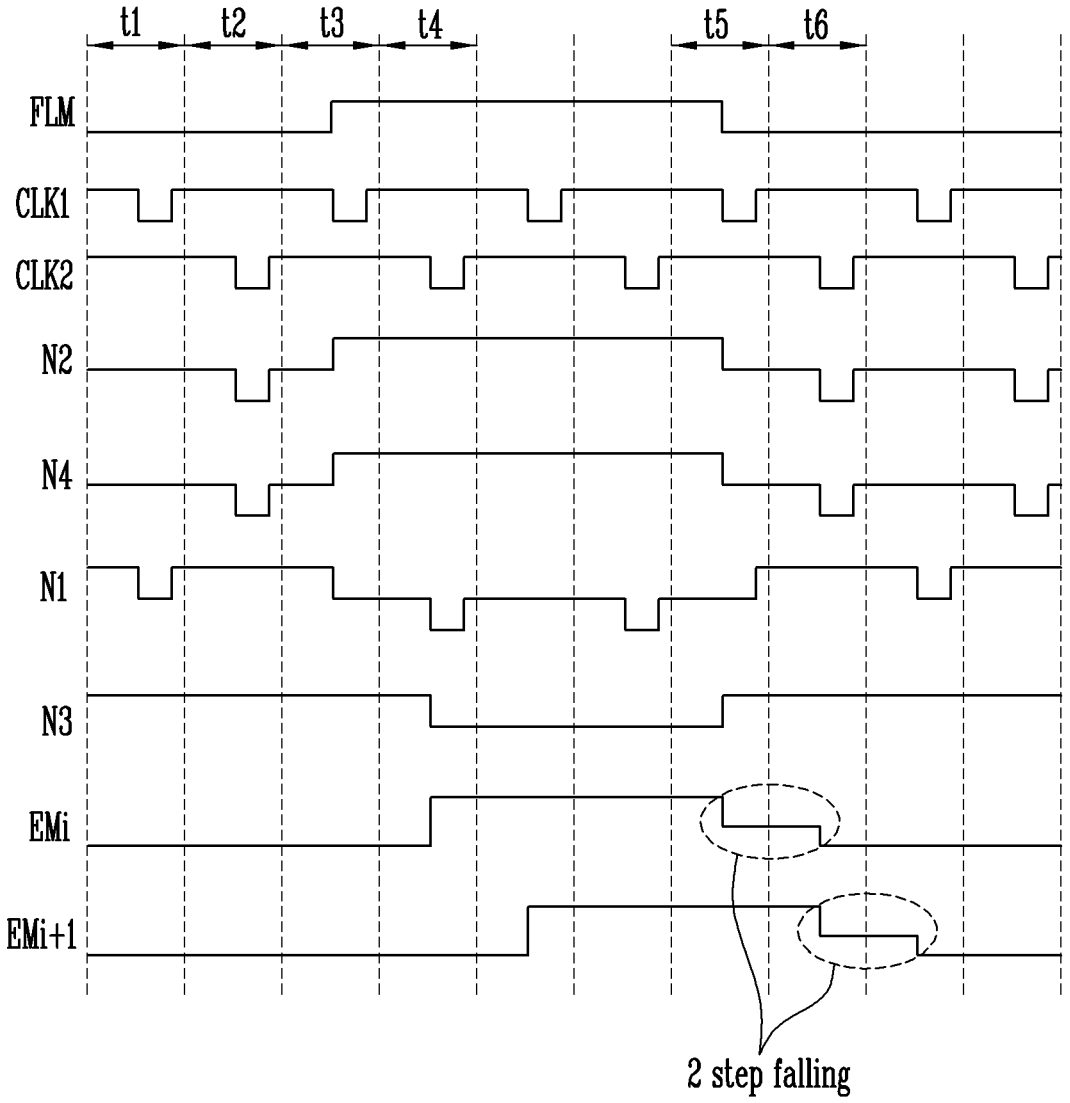
FIG. 5 is a waveform diagram of an operation of the stage shown in FIG. 4 according to some exemplary embodiments.

FIG. 5 is a waveform diagram of an operation of the stage shown in FIG. 4 according to some exemplary embodiments.

Referring to FIG. 5, an operation flow of the stage 400 shown in FIG. 4 will be described. Hereinafter, since it has been assumed that the transistors constituting the stage 400 shown in FIG. 4 are P-type transistors, the first clock signal CLK1 and/or the second clock signal CLK2 having a low level may mean that "the first clock signal CLK1 and/or the second clock signal CLK2 is supplied to the stage 400."

Referring to FIG. 5, the first clock signal CLK1 and the second clock signal CLK2 may have a period of two horizontal periods 2H, and have a gate-on level in different horizontal periods. That is, the second clock signal CLK2 may be a signal shifted by a half period (or one horizontal period 1H) from the first clock signal CLK1.

In addition, the emission start signal FLM or the carry signal CR[i−1] of the previous stage input to the input circuit 410 may be supplied together with the first clock signal CLK1 to the input circuit 410 in a period (or half period) or more of the first clock signal CLK1. For example, a period in which the emission start signal FLM or the carry signal CR[i−1] of the previous stage is input to the input circuit 410 may be twice or more greater than the period of the first clock signal CLK1. It is noted that a case where the emission start signal FLM or the carry signal CR[i−1] of the previous stage is input during about four horizontal periods 4H is illustrated in FIG. 5.

Referring to FIGS. 4 and 5, an operation of the stage 400 in a first period t1 will be described as follows.

In a first period t1, when the first clock signal CLK1 is changed to a low level (or when the first clock signal CLK1 is supplied), the first transistor T1 and the fifth transistor T5 of the input circuit 410 are turned on. Since the second clock signal CLK2 maintains a high level, the sixth transistor T6 is turned off.

When the first transistor T1 is turned on, the emission start signal FLM with a low level or the carry signal CR[i−1] of the previous stage with a low level that is input to the input circuit 410 may be transferred to the second node N2. Accordingly, a low level voltage is applied to the second node N2. When the low level voltage is applied to the second node N2, the fourth transistor T4 and the eighth transistor T8 are turned on.

In addition, since the twelfth transistor T12 may always maintain the turn-on state, the voltage of the node N2 is transferred to the fourth node N4 as it is so that the low level voltage is applied to the fourth node N4. Therefore, when the low level voltage is applied to the fourth node N4, the tenth transistor T10 and the third transistor T3 are turned on.

When the third transistor T3 is turned on, a high level voltage according to the second clock signal CLK2 is applied to the seventh node N7. Therefore, the third capacitor C3 coupled between the fourth node N4 having the low level voltage and the seventh node N7 having the high level voltage charges a voltage applied between the fourth node N4 and the seventh node N7.

When the fourth transistor T4 is turned on, the fifth transistor T5 coupled between the first node N1 and the second power source VGL may operate as a diode. Therefore, although the fifth transistor T5 is turned on, a low level voltage of the second power source VGL is not transferred to the first node N1, and the first node N1 may maintain a voltage of a previous state (e.g., a high level voltage as shown in FIG. 5).

When the first node N1 maintains the high level voltage, the second transistor T2 is turned off. In addition, since the voltage of the first node N1 is transferred to the fifth node N5 by the eleventh transistor T11, which may always maintain the turn-on state, a high level voltage is applied to the fifth node N5. When the high level voltage is applied to the fifth node N5, the is seventh transistor T7 is turned off.

When the eighth transistor T8 is turned on, a voltage according to the first power source VGH is applied to the third node N3 such that the ninth transistor T9 is turned off.

When the tenth transistor T10 is turned on, a low level voltage according to the second power source VGL is output as the emission control signal EMi to the output terminal 104. When the emission control signal EMi has the low level voltage, it may be defined that the emission control signal Emi at the low level voltage is supplied to a pixel (since the fifth transistor M5 and the sixth transistor M6 are turned on in the pixel shown in FIG. 2).

In FIG. 5, an operation of the stage 400 in a second period t2 will be described as follows.

In the second period t2, the first clock signal CLK1 maintains the high level voltage. Therefore, the first transistor T1 and the fifth transistor T5 are turned off. However, although the first transistor T1 and the fifth transistor T5 are turned off, the third node N3 maintains a voltage (e.g., a high level voltage) of a previous state by the first capacitor C1, and the fourth node N4 maintains a voltage (e.g., a low level voltage) of a previous state by the third capacitor C3. Therefore, when the third node N3 has the high level voltage, the ninth transistor T9 maintains a turn-off state. Since the fourth node N4 maintains the low level voltage, the third transistor T3, the fourth transistor T4, the eighth transistor T8, and the tenth transistor T10 maintain the turn-on state.

In the second period t2, when the second clock signal CLK2 is changed to a low level, the sixth transistor T6 is turned on. When the sixth transistor T6 is turned on, the high level voltage of the third node N3 is applied to the sixth node N6.

In addition, when the third transistor T3 is turned on, a low level voltage according to the second clock signal CLK2 is applied to the seventh node N7. A voltage lower by the voltage of the third capacitor C3 than the voltage applied to the seventh node N7 is applied to the fourth node N4.

In FIG. 5, an operation of the stage 400 in a third period t3 will be described as follows.

In the third period t3, since the second clock signal CLK2 maintains the high level voltage, the sixth transistor T6 is turned off. Also, in the third period t3, the emission start signal FLM with a high level or the carry signal CR[i−1] of the previous stage with a high level is input to the input circuit 410, and the first clock signal CLK1 is changed to a low level.

When the first clock signal CLK is changed to the low level, the first transistor T1 and the fifth transistor T5 are turned on.

When the first transistor T1 is turned on, the emission start signal FLM with the high level or the carry signal CR[i−1] of the previous stage with the high level that is input to the input circuit 410 may be transferred to the second node N2. Accordingly, a high level voltage is applied to the second node N2. When the high level voltage is applied to the second node N2, the fourth transistor T4 and the eighth transistor T8 are turned off.

In addition, since the twelfth transistor T12 may maintain the turn-on state, the voltage of the node N2 is transferred to the fourth node N4 as it is so that the high level voltage applied to the fourth node N4. Therefore, when the high level voltage is applied to the fourth node N4, the tenth transistor T10 and the third transistor T3 are turned off.

When the fifth transistor T5 is turned on, a low level voltage according to the second power source VGL is applied to the first node N1. In addition, since the eleventh transistor T11 may always be in the turn-on state, the low level voltage according to the second power source VGL may also be applied to the fifth node N5. Therefore, the second transistor T2 is turned on by the low level voltage of the first node N1, and the seventh transistor T7 is turned on by the low level voltage of the fifth node N5.

When the second transistor T2 is turned on, a voltage of the first power source VGH is applied to the seventh node N7. Since the third transistor T3 may maintain the turn-off state, the second clock signal CLK2 may not be transferred to the seventh node N7. In addition, since both the voltages applied to the seventh node N7 and the second node N2 (or the fourth node N4) coupled to the third capacitor C3 have a high level voltage, no voltage difference occurs in the third capacitor C3, and no charge/discharge is performed.

When the seventh transistor T7 is turned on, a high level voltage according to the second clock signal CLK2 is applied to the sixth node N6. Since the second clock signal CLK2 has the high level voltage, the sixth transistor T6 is turned off. Since a low level voltage is applied to the fifth node N5, a differential voltage between the high level voltage applied to the sixth node N6 and the low level voltage applied to the fifth node N5 (or a turn-on voltage of the seventh transistor T7) is stored in the second capacitor C2.

In FIG. 5, an operation of the stage 400 in a fourth period t4 will be described as follows.

In the fourth period t4, the first clock signal CLK1 maintains the high level, and the second clock signal CLK2 is changed to a low level. Therefore, the first transistor T1 and the fifth transistor T5 maintain the turn-off state, and the sixth transistor T6 is turned on.

The seventh transistor T7 is in the turn-on state by the second capacitor C2 as described in the third period t3. Therefore, when the sixth transistor T6 is turned on, a low level voltage according to the second clock signal CLK2 may be applied to the sixth node N6 and the third node N3. When the low level voltage is applied to the third node N3, the ninth transistor T9 is turned on.

When the ninth transistor T9 is turned on, the emission control signal EMi having a high level is output through the output terminal 104 while a current is flowing to the output terminal 104 from the first power source VGH.

A voltage lower by a voltage difference according to the second capacitor C2 (e.g., a voltage lower by two steps) than the low level voltage according to the sixth node N6 is applied to the fifth node N5 (or the first node N1). In this manner, there may be a coupling effect of the second capacitor C2.

In FIG. 5, an operation of the stage 400 in a fifth period t5 will be described as follows.

In the fifth period t5, since the second clock signal CLK2 maintains the high level, the sixth transistor T6 maintains the turn-off state. Since the first clock signal CLK1 is changed to a low level, the first transistor T1 and the fifth transistor T5 may be turned on.

When the first transistor T1 is turned on, the emission start signal FLM with a low level or the carry signal CR[i−1] of the previous stage with a low level that is input to the input circuit 410 may be transferred to the second node N2. Accordingly, the second node N2 is changed to a low level. When the second node N2 is changed to the low level, the fourth transistor T4 and the eighth transistor T8 are turned on.

In addition, since the twelfth transistor T12 may always maintain the turn-on state, the voltage of the second node N2 may be transferred to the fourth node N4 as it is so that a low level voltage is applied to the fourth node N4. Therefore, when the low level voltage is applied to the fourth node N4, the tenth transistor T10 and the third transistor T3 are turned on.

When the third transistor T3 is turned on, a high level voltage according to the second clock signal CLK2 is applied to the seventh node N7. Therefore, the third capacitor C3 coupled between the fourth node N4 having the low level voltage and the seventh node N7 having the high level voltage charges a voltage applied between the fourth node N4 and the seventh node N7.

When the fourth transistor T4 is turned on, the fifth transistor T5 coupled between the first node N1 and the second power source VGL may operate as a diode. Therefore, although the fifth transistor T5 is turned on, a low level voltage according to the second power source VGL is not transferred to the first node N1, and the first node N1 may maintain a voltage of a previous state (e.g., a low level voltage as shown in FIG. 5).

When the first node N1 maintains the low level voltage, the second transistor T2 is turned on. In addition, since the voltage of the first node N1 is transferred to the fifth node N5 by the eleventh transistor T11, which may always maintain the turn-on state, a low level voltage is applied to the fifth node N5. When the low level voltage is applied to the fifth node N5, the seventh transistor T7 is turned on.

When the second transistor T2 is turned on, a high voltage according to the first power source VGH may be applied to the seventh node N7.

In addition, when the seventh transistor T7 is turned on, a high level voltage according to the second clock signal CLK2 is applied to the sixth node N6.

When the eighth transistor T8 is turned on, the voltage of the first power source VGH is applied to the third node N3 so that the ninth transistor T9 is turned off.

When the tenth transistor T10 is turned on, the emission control signal EMi output to the output terminal 104 is changed to a low level. However, a low level output of the emission control signal EMi is slightly high as shown in FIG. 5. In order to solve this problem, the first auxiliary circuit 450 shown in FIG. 4 may additionally lower the low level output of the emission control signal EMi.

In FIG. 5, an operation of the stage 400 in a sixth period t6 will be described as follows.

In the sixth period t6, the second clock signal CLK2 is changed to a low level so that a low level voltage according to the second clock signal CLK2 is applied to the seventh node N7 through the third transistor T3. The third capacitor C3 lowers by one step, the voltage of the fourth node N4 by a voltage charged therein. When the voltage of the fourth node N4 is further lowered by coupling of the third capacitor C3, the magnitude of an absolute value of the voltage difference Vgs between the gate electrode and the source electrode of the tenth transistor T10 is further increased, and therefore, the emission control signal EMi may be lowered to a level lower in one step.

Thus, after the emission control signal EMi output to the output terminal 104 of the stage 400 is changed to a first low level as the emission start signal FLM is changed to the low level in the fifth period t5 as shown in FIG. 5, the first auxiliary circuit 450 operates as the second clock signal CLK2 is changed to the low level in the sixth period t6 to change the emission control signal EMi to a second low level lower in one step than the first low level.

As described above, in accordance with the stage 400 described in association with FIG. 4, the emission control signal EMi may be changed to a low level voltage (e.g., a voltage defined to be in a state in which the emission control signal EMi is supplied) as the emission control signal EMi is lowered step-by-step (e.g., a two (2) step falling). Therefore, when the emission control signal EMi is lowered step-by-step, an overcurrent is generated in a determined pixel, and therefore, a problem such as an increase in power consumption may occur. Accordingly, in some embodiments, a stage is additionally proposed in which the emission control signal EMi is not lowered step-by-step, but may be lowered in a single step form.

Figure 6:
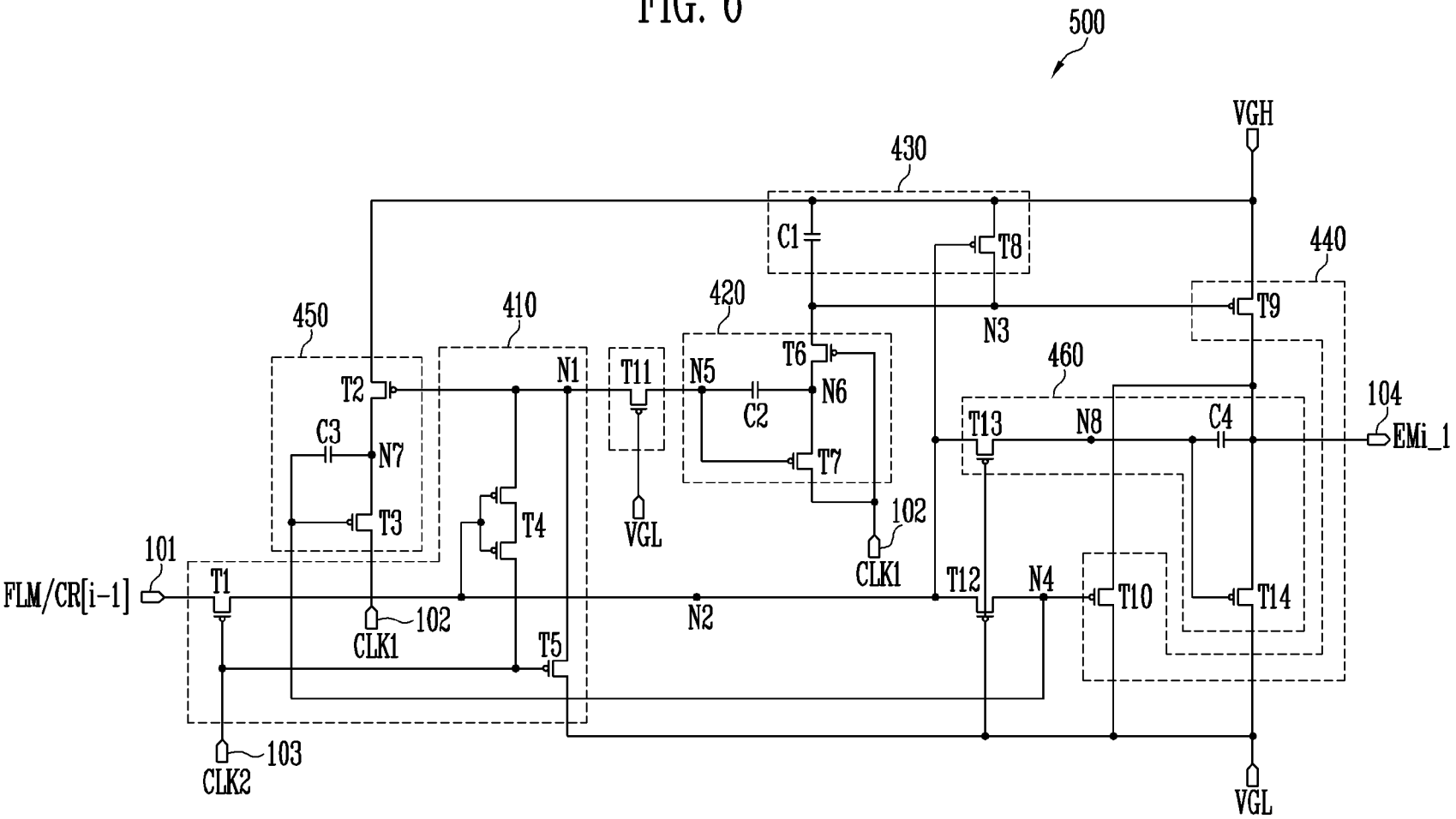
FIG. 6 is a circuit diagram of a second illustrative stage shown in FIG. 3 according to some exemplary embodiments.

FIG. 6 is a circuit diagram a second illustrative stage shown in FIG. 3 according to some exemplary embodiments.

Referring to FIG. 6, it can be seen that the stage 500 in accordance with some embodiments is an improved circuit in that the emission control signal EMi_1 is different from the emission control signal EMi output from the stage 400. For instance, the emission control signal EMi_1 is not lowered step-by-step as will become more apparent below.

Referring to FIG. 6, based on the stage 400 described in association with FIG. 4, the stage 500 in accordance with some embodiment may further include a second auxiliary circuit 460, which controls the low level output of the emission control signal EMi_1 in a single step form by a voltage applied to the second node N2.

The second auxiliary circuit 460 may include a thirteenth transistor T13, a fourteenth transistor T14, and a fourth capacitor C4.

The fourteenth transistor T14 may be coupled between the output terminal 104 and the second power source VGL. A gate electrode of the fourteenth transistor T14 may be coupled to an eighth node N8.

The thirteenth transistor T13 may be coupled between the second node N2 and the eighth node N8. A gate electrode of the thirteenth transistor T13 may be coupled to the second power source VGL.

The fourth capacitor C4 may be coupled between the eighth node N8 and the output terminal 104.

When the emission start signal FLM or the carry signal CR[i−1] of the previous stage is changed from a high level to a low level, a low level voltage is applied to the second node N2. The second auxiliary circuit 460 additionally lowers a voltage of the eighth node N8 coupled to the gate electrode of the fourteenth transistor T14 by a voltage charged in the fourth capacitor C4 based on the voltage applied to the second node N2 being changed from a high level to a low level. Therefore, since a width where a voltage difference between the gate electrode and a source electrode of the fourteenth transistor T14 is maintained lower than a threshold voltage of the fourteenth transistor T14, the emission control signal EMi may be lowered (e.g., immediately lowered) to the second low level, instead of the two (2) step failing shown in FIG. 5.

Unlike the stage 400, in the stage 500, positions of the input terminal to which the first clock signal CLK1 is applied and the input terminal to which the second clock signal CLK2 is applied have been reversed. This is for the purpose of representing that, in a relationship between the stages shown in FIG. 3, the first clock signal CLK1 and the second clock signal CLK2, which are input for each stage, are alternately input. Therefore, the positions at which the first clock signal CLK1 and the second clock signal CLK2 are applied in the stage 500 may be reversed as compared to the stage 400.

Figure 7:
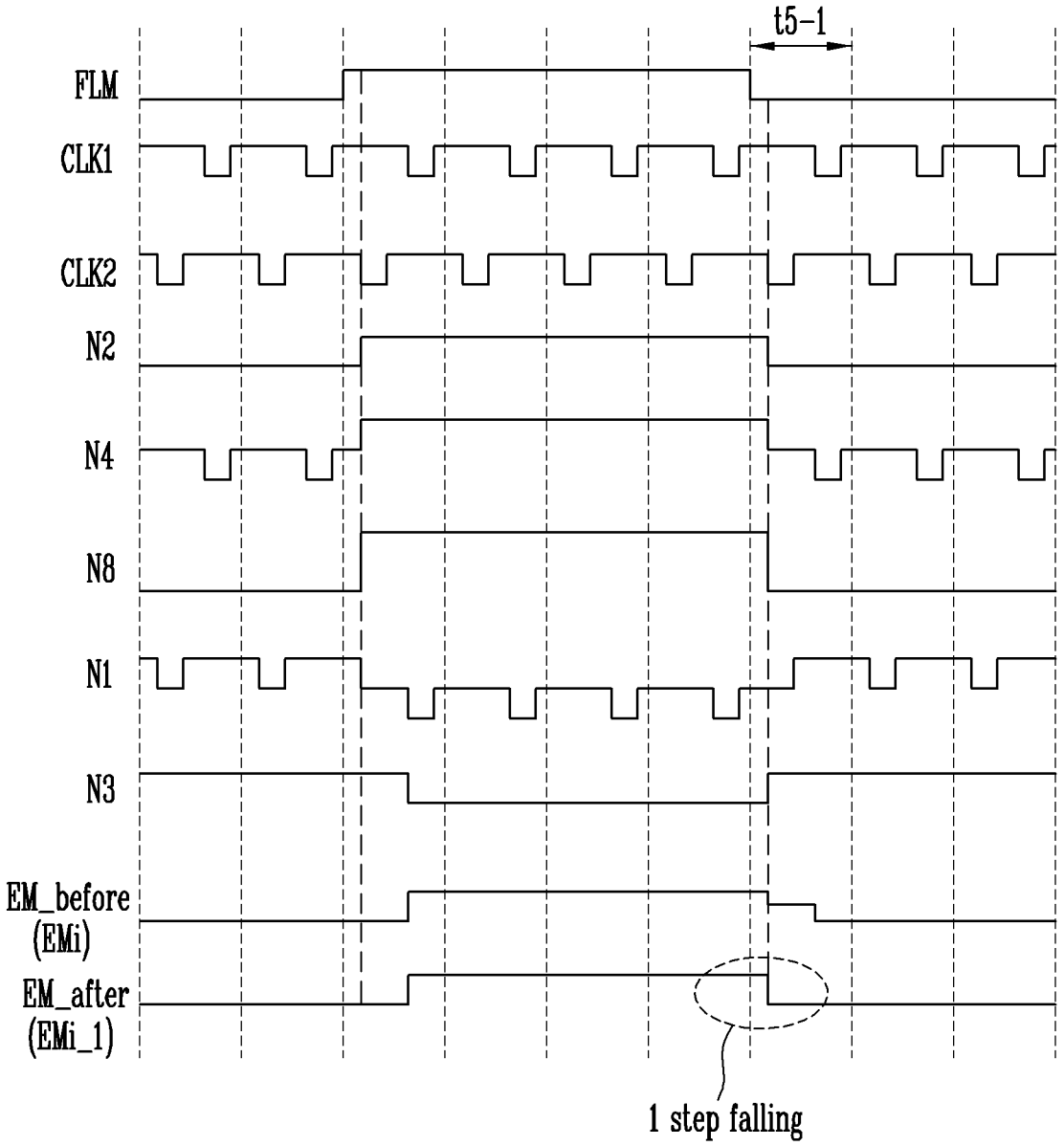
FIG. 7 is a waveform diagram of an operation of the stage shown in FIG. 6 according to some exemplary embodiments.

FIG. 7 is a waveform diagram illustrating an operation of the stage shown in FIG. 6 according to some exemplary embodiments.

Referring to FIG. 7, an operational wavelength of the stage 500 shown in FIG. 6 can be seen. The first clock signal CLK1 and the second clock signal CLK2 may have a period of one horizontal period 1H, and have a gate-on level in different horizontal periods.

In FIG. 7, a period t5−1 in which the emission start signal FLM is changed to a low level will be described. The first transistor T1 of the stage 500 may be turned on as the emission start signal FLM is changed to the low level and the second clock signal CLK2 is changed to a low level. Therefore, since the emission start signal FLM having the low level is transferred to the second node N2, the second node N2 may be changed to a low level.

In addition, when the second node N2 is changed to the low level, the eighth node N8 is changed to a low level by the thirteenth transistor T13, which may always be in the turn-on state. When the eighth node N8 is changed to the low level, the emission control signal EMi_1 starts being lowered as the fourteenth transistor T14 is being turned on. When the emission control signal EMi_1 is lowered, the magnitude of an absolute value of the voltage difference Vgs between the gate electrode (or the eighth node N8) and the source electrode (or the output terminal 104) of the fourteenth transistor T14 is further increased by the fourth capacitor C4. As such, since the magnitude of the absolute value of the voltage difference Vgs between the gate electrode and the source electrode of the fourteenth transistor T14 is increased, the emission control signal EMi_1 may be lowered (e.g., immediately lowered) to the second low level by the fourth capacitor C4 (e.g., may cause a one (1) step falling).

For example, the emission control signal EM_before (or EMi) of the stage 400 is lowered to the first low level when the emission control signal EM_before is changed to the low level, and then is lowered to the second low level by the first auxiliary circuit 450 as the first clock signal CLK1 is changed to the low level. On the other hand, the emission control signal EM_after (or EMi_1) of the stage 500 be lowered (e.g., immediately lowered) to the second low level by the second auxiliary circuit 460.

Figure 8:
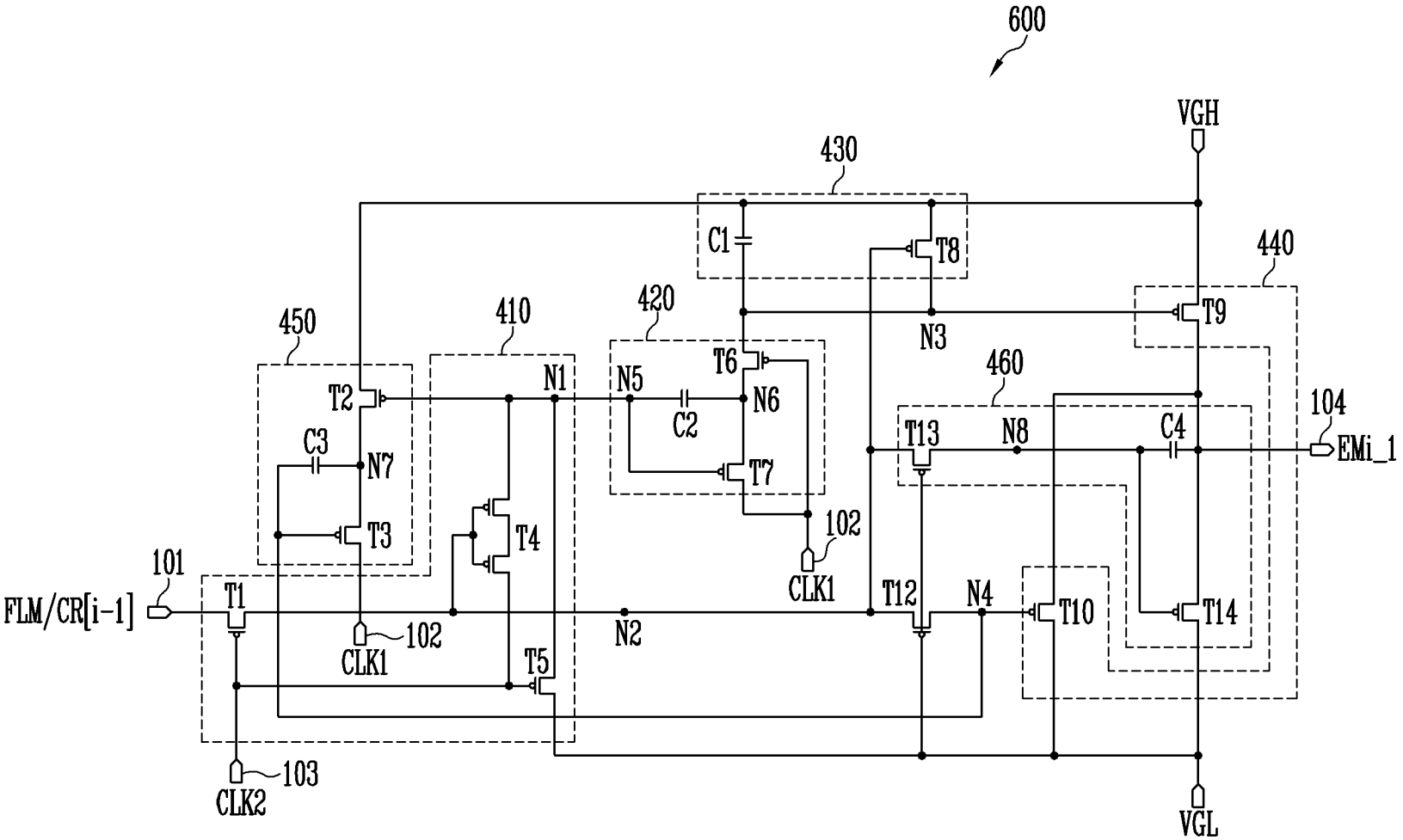
FIG. 8 is a circuit diagram of a third illustrative stage shown in FIG. 3 according to some exemplary embodiments.

FIG. 8 is a circuit diagram of a third illustrative stage shown in FIG. 3 according to some exemplary embodiments.

The stage 500 described in association with FIG. 6 includes the eleventh transistor T11 having the gate electrode coupled to the second power source VGL to always maintain the turn-on state. The eleventh transistor T11 is used to stably control the voltage drop width of the first node N1, and has no substantial influence on an operation of the circuit.

Therefore, when a problem, such as a leakage current due to a characteristic of the light emitting device does not occur, the eleventh transistor T11 may be omitted in the stage 500. For instance, referring to FIG. 8, the stage 600 in accordance with some embodiments omits the eleventh transistor T11.

As described above, in the stage 600 in which the eleventh transistor T11 is omitted, it is considered that the first node N1 and the fifth node N1 are the same. In another sense, the first node N1 and the fifth node N5 are short-circuited.

Figure 9:
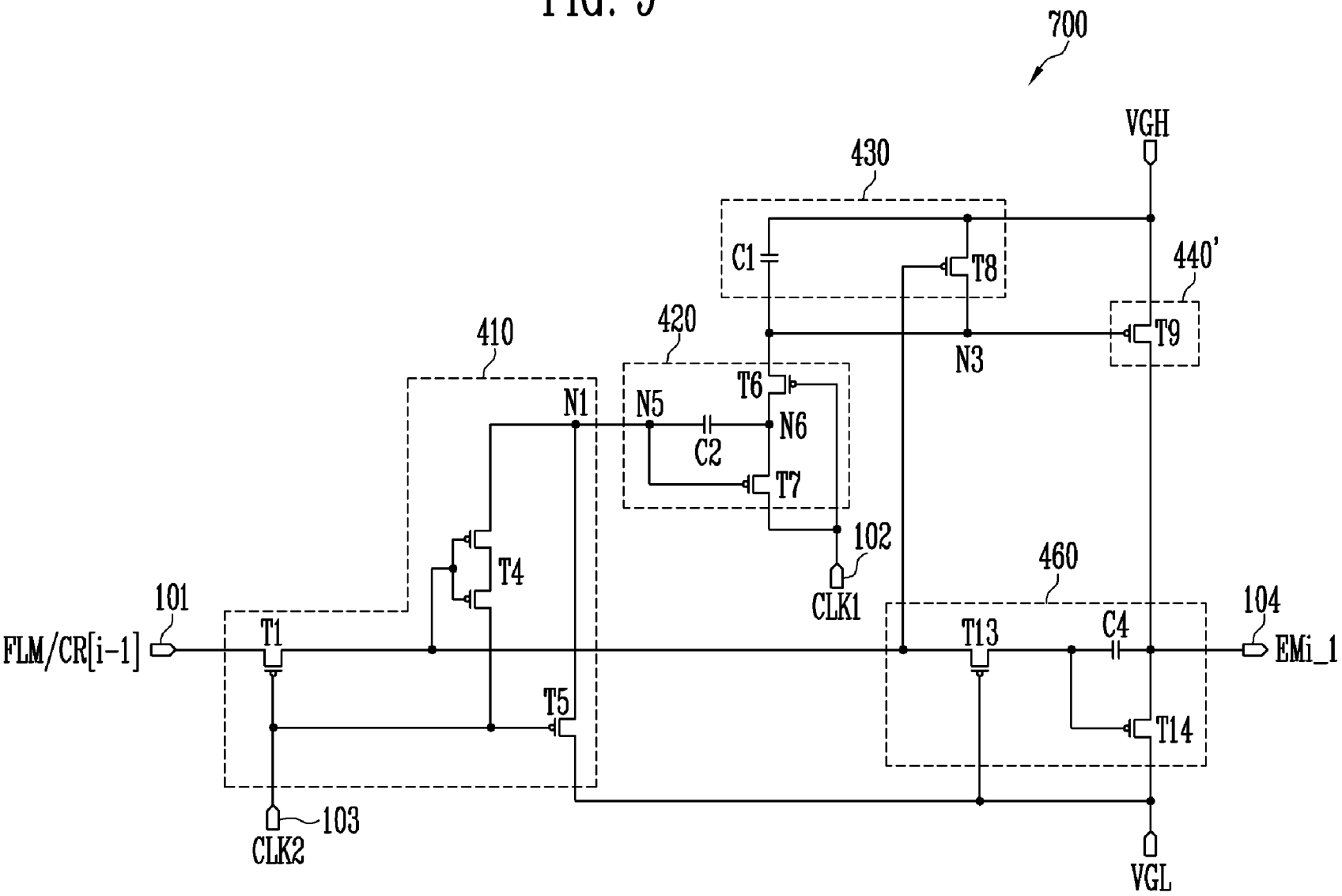
FIG. 9 is a circuit diagram a fourth illustrative stage shown in FIG. 3 according to some exemplary embodiments.

FIG. 9 is a circuit diagram a fourth illustrative stage shown in FIG. 3 according to some exemplary embodiments.

In the stage 400 described in association with FIG. 4, a low level voltage according to the second power source VGL is always applied to the gate electrode of each of the eleventh transistor T11 and the twelfth transistor T12 so that the eleventh transistor T11 and the twelfth transistor T12 maintain the turn-on state.

Therefore, since the eleventh transistor T11 and the twelfth transistor T12 are used to stably control the voltage drop width, the eleventh transistor T11 and the twelfth transistor T12 may be omitted as long as a problem, such as a leakage current due to a characteristic of the light emitting device EL does not occur.

Also, in the stage 400 described in association with FIG. 4, the first auxiliary circuit 450 may be omitted as long as there is no problem, such as an increase in power consumption when the emission control signal EMi_1 has a low level.

Also, in the stage 400 described in association with FIG. 4, the tenth transistor T10 may be omitted. Accordingly, the output circuit 440' can be simplified.

Also, in the stage 400 described in association with FIG. 4, when the fourth capacitor C4 is additionally coupled between the fourth node N4 and the output terminal 104, a form identical to that of the second auxiliary circuit 460 described in association with FIG. 6 may be configured. When a structure identical to that of the second auxiliary circuit 460 is maintained, the time for which the emission control signal EMi_1 is lowered to a low level can be reduced due to the fourth capacitor C4.

Accordingly, in the stage 700 as compared to the stage 400, the eleventh transistor T11, the twelfth transistor T12, and the first auxiliary circuit 450 are omitted, and the fourth capacitor C4 is added so that a simplified stage 700 can be configured as shown in FIG. 9.

According to various exemplary embodiments, in a light emission control driver and a display device including the same, an output characteristic when an emission control signal is lowered to a low level may be improved to a single step form so that generation of an instantaneous current can be prevented or at least reduced. Further, the emission control signal may be maintained at a sufficiently low level so that power consumption can be reduced.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A light emission control driver comprising:

stages configured to supply an emission control signal to emission control lines, wherein each of the stages comprises:

an input circuit configured to control a voltage of a first node and a voltage of a second node based on a first clock signal and one of an emission start signal and a carry signal of a previous stage among the stages;

a first main circuit configured to control a voltage of a third node based on the voltage of the first node and a second clock signal;

a second main circuit configured to control the voltage of the third node based on the voltage of the second node such that the third node has a voltage level opposite a voltage level of the second node;

an output circuit configured to control the emission control signal output to an output terminal based on the voltage of the second node and the voltage of the third node;

a first auxiliary circuit configured to control a low level output of the emission control signal such that the emission control signal is further lowered from a first low level to a second low level based on the second clock signal; and a second auxiliary circuit configured to control the low level output of the emission control signal in a single step from a high level to the second low level based on the voltage of the second node, wherein the second auxiliary circuit comprises:

a fourth capacitor coupled between an eighth node and the output terminal;

a thirteenth transistor coupled between the second node and the eighth node, the thirteen transistor comprising a gate electrode coupled to a second power source; and a fourteenth transistor coupled between the output terminal and the second power source, the fourteenth transistor comprising a gate electrode coupled to the eighth node.

2. The light emission control driver of claim 1, wherein the fourth capacitor is configured to increase a magnitude of an absolute value of a voltage difference between the eighth node and the output terminal such that the emission control signal is changed to the second low level from the high level in response to a low level voltage being applied to the second node.

3. The light emission control driver of claim 1, further comprising:

a twelfth transistor configured to limit a voltage drop width of the second node, the second node being coupled between the input circuit and the output circuit.

4. The light emission control driver of claim 3, wherein:

the twelfth transistor is coupled between the second node and a fourth node; and the twelfth transistor comprises a gate electrode coupled to the second power source.

5. The light emission control driver of claim 4, wherein the first auxiliary circuit is configured to lower a voltage of the fourth node based on the voltage of the fourth node and the second clock signal.

6. The light emission control driver of claim 5, wherein the first auxiliary circuit comprises:

a third capacitor coupled between the fourth node and a seventh node;

a third transistor coupled between the seventh node and a third input terminal configured to receive the second clock signal, the third transistor comprising a gate electrode coupled to the fourth node; and a second transistor coupled between a first power source and the seventh node, the second transistor comprising a gate electrode coupled to the first node.

7. The light emission control driver of claim 6, wherein the third capacitor is configured to further lower a low level of the voltage of the fourth node as the emission start signal or the carry signal of the previous stage changes to a low level.

8. The light emission control driver of claim 1, wherein the input circuit comprises:

a first transistor coupled between a second node and a first input terminal configured to receive the one of the emission start signal and the carry signal, the first transistor comprising a gate electrode coupled to a second input terminal configured to receive the first clock signal;

a fourth transistor coupled between the first node and the second input terminal, the fourth transistor comprising a gate electrode coupled to the second node; and a fifth transistor coupled between the first node and a second power source.

9. The light emission control driver of claim 1, wherein the first main circuit comprises:

a sixth transistor coupled between the third node and a sixth node, the sixth transistor comprising a gate electrode coupled to a third input terminal configured to receive the second clock signal;

a seventh transistor coupled between the sixth node and the third input terminal, the seventh transistor comprising a gate electrode coupled to the first node; and a second capacitor coupled between the sixth node and the first node.

10. The light emission control driver of claim 1, wherein the second main circuit comprises:

an eighth transistor coupled between a first power source and the third node, the eighth transistor comprising a gate electrode coupled to the second node; and a first capacitor coupled between the first power source and the third node.

11. The light emission control driver of claim 1, wherein the output circuit comprises:

a ninth transistor coupled between a first power source and the output terminal, the ninth transistor comprising a gate electrode coupled to the third node; and a tenth transistor coupled between the output terminal and a second power source, the tenth transistor comprising a gate electrode coupled to the second node.

12. The light emission control driver of claim 1, further comprising:

an eleventh transistor configured to limit a voltage drop width of the first node, the first node being coupled between the input circuit and the first main circuit.

13. The light emission control driver of claim 12, wherein the eleventh transistor comprises a gate electrode coupled to a second power source, the second power source being configured to maintain a turn-on state of the eleventh transistor.

14. A display device comprising:

pixels;

a scan driver configured to supply a scan signal to the pixels;

a data driver configured to supply a data signal to the pixels;

a light emission control driver comprising stages configured to supply an emission control signal to the pixels; and a timing controller configured to control driving of the scan driver, the data driver, and the light emission control driver, wherein each of the stages comprises:

an input circuit configured to control a voltage of a first node and a voltage of a second node based on a first clock signal and one of an emission start signal and a carry signal of a previous stage;

a first main circuit configured to control a voltage of a third node based on the voltage of the first node and a second clock signal;

a second main circuit configured to control the voltage of the third node based on the voltage of the second node such that the third node has a voltage level opposite a voltage level of the second node;

an output circuit configured to control an emission control signal output to an output terminal based on the voltage of the second node and the voltage of the third node;

a first auxiliary circuit configured to control a low level output of the emission control signal such that the emission control signal is further lowered from a first low level to a second low level based on the second clock signal; and a second auxiliary circuit configured to control the low level output of the emission control signal in a single step from a high level to the second low level based on the voltage of the second node, wherein the second auxiliary circuit comprises:

a fourth capacitor coupled between an eighth node and the output terminal;

a thirteenth transistor coupled between the second node and the eighth node, the thirteen transistor comprising a gate electrode coupled to a second power source; and a fourteenth transistor coupled between the output terminal and the second power source, the fourteenth transistor comprising a gate electrode coupled to the eighth node.

15. The display device of claim 14, wherein the fourth capacitor is configured to increase a magnitude of an absolute value of a voltage difference between the eighth node and the output terminal such that the emission control signal is changed to the second low level from the high level in response to a low level voltage being applied to the second node.

16. The display device of claim 14, wherein the output circuit comprises:

a ninth transistor coupled between a first power source and the output terminal, the ninth transistor comprising a gate electrode coupled to the third node; and a tenth transistor coupled between the output terminal and a second power source, the tenth transistor comprising a gate electrode coupled to the second node.

17. The display device of claim 14, wherein:

periods of the first clock signal and the second clock signal are equivalent; and the first clock signal and the second clock signal have a phase difference of a half period.

18. The display device of claim 14, wherein the carry signal comprises an emission control signal of the previous stage.

* * * * *